US012703468B2

(12) United States Patent
Woodruff et al.

(10) Patent No.: US 12,703,468 B2
(45) Date of Patent: Aug. 11, 2026

(54) BEACHING PROPELLER

(71) Applicant: RAIDER OUTBOARDS, INC., Titusville, FL (US)

(72) Inventors: Michael Woodruff, Titusville, FL (US); David Woodruff, Titusville, FL (US); Christopher Woodruff, Titusville, FL (US)

(73) Assignee: RAIDER OUTBOARDS, INC., Titusville, FL (US)

( * ) Notice: Subject to any disclaimer, the term of this patent is extended or adjusted under 35 U.S.C. 154(b) by 564 days.

(21) Appl. No.: 18/336,563

(22) Filed: Jun. 16, 2023

(65) Prior Publication Data

US 2024/0286723 A1 Aug. 29, 2024

Related U.S. Application Data

(60) Provisional application No. 63/353,062, filed on Jun. 17, 2022.

(51) Int. Cl.

| | |
|---|---|
| ***B63H 1/20*** | (2006.01) |
| ***B63H 1/15*** | (2006.01) |
| ***B63H 1/26*** | (2006.01) |
| ***B63H 21/32*** | (2006.01) |

(52) U.S. Cl.
CPC ..... *B63H 1/20* (2013.01); *B63H 1/15* (2013.01); *B63H 1/26* (2013.01); *B63H 21/32* (2013.01)

(58) Field of Classification Search
CPC ... B63H 1/20; B63H 1/15; B63H 1/26; B63H 21/32
See application file for complete search history.

(56) References Cited

U.S. PATENT DOCUMENTS

| | | | | |
|---|---|---|---|---|
| 4,212,586 A * | 7/1980 | Aguiar | B63H 1/20 416/93 A |
| 4,619,584 A * | 10/1986 | Brandt | B63H 20/16 416/201 A |
| 6,267,634 B1 * | 7/2001 | Ewald | B63H 1/20 440/89 R |
| 9,914,515 B1 * | 3/2018 | Powers | B63H 1/28 |
| 2007/0065282 A1 * | 3/2007 | Patterson | B63H 1/26 416/93 A |
| 2019/0127035 A1 * | 5/2019 | McKinny, Jr. | B63H 5/10 |
| 2022/0119132 A1 * | 4/2022 | Dakhil | B64B 1/34 |

* cited by examiner

*Primary Examiner* — Andrew J Marien
(74) *Attorney, Agent, or Firm* — Studebaker Brackett PLLC

(57) ABSTRACT

A propeller including a propeller hub, two or more blades connected with the propeller hub, and an insert having a tubular shape with an inner and outer face. The insert having a raised ridge on the inner face and the insert being inserted in at least a portion of the propeller hub.

19 Claims, 8 Drawing Sheets

BEACHING PROPELLER

PRIORITY CLAIM

The present application claims the priority of U.S. Provisional Application No. 63/353,062 filed Jun. 17, 2022, which is incorporated herein by reference in its entirety.

BACKGROUND

The purpose of a beaching propeller is to improve mission performance of a Combat Rubber Raiding Craft (CRRC), i.e., a fabricated rubber inflatable boat, by one or more of reducing acoustic signatures, making a lighter propeller with strength better than aluminum and designed for beaching. This propeller can also be scaled up to operate with stern drives primarily for military elements conducting littoral coastal missions including hydrographic reconnaissance or in surf passage. Currently used propellers are subject to damage during use. Propeller breakage is becoming a significant issue in training and on missions.

Propulsion of the CRRC is achieved by a propeller using angled blades which generate lift; water fills in the space made by the propeller as the propeller pushes water aside. This creates a pressure differential between the two sides of the blade and forms a negative pressure on the forward side of the blade and a positive pressure on the aft side of the blade. The pressure differential draws water into the propeller from the front and accelerates it out the back creating a "cylinder" of water that exits the propeller and propels the boat in the opposite direction of the thrust. Fewer blades on a propeller equate to greater efficiency, while more blades enable greater power input and loading.

Understanding propellers and the materials currently used to manufacture propellers is relevant. Presently, propellers are often made from either a stainless-steel alloy, aluminum, nickel-aluminum-bronze alloy, or a manganese bronze alloy with very sharp edges. The costliest material, stainless steel, is very easily repaired and stands up to quite a bit of abuse. The hardest alloy is nickel-aluminum-bronze. Manganese bronze propellers are the least expensive in terms of materials, and when they do impact a hard object, they can often be bent back into shape when being repaired. Beaching propellers can be made with these materials for any commercial application but will lack acoustic and strength parameters.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
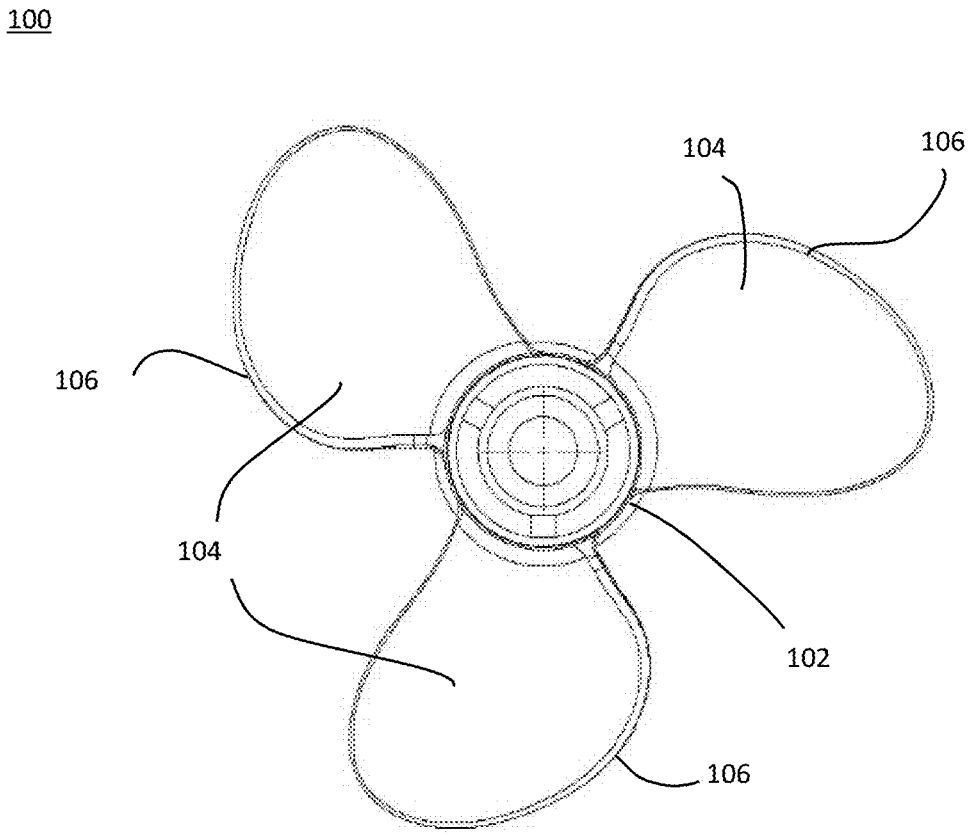
FIG. 1 is a front view of a beaching propeller, in accordance with some embodiments.

The following disclosure provides many different embodiments, or examples, for implementing different features of the provided subject matter. Specific examples of components, values, operations, materials, arrangements, or the like, are described below to simplify the present disclosure. These are, of course, merely examples and are not intended to be limiting. Other components, values, operations, materials, arrangements, or the like, are contemplated. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below." "lower." "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

Example embodiments in general relate to an outboard motor propeller. More specifically it relates to a propeller that allows beaching of a military Combat Rubber Raiding Craft (CRRC) with minimal impact or damage from objects encountered during military operations. This beaching propeller can be used on both inboard and outboard motor applications.

An example embodiment of the present invention is directed to impacts from using the graphene material along with making the propeller edge blunter to withstand the beaching better than the conventional propellers. The beaching propeller designed for the outboard motor includes a hub, a ridge insert located in the back of the propeller and multiple propeller blades that form a complete a body known as a propeller.

The beaching propeller design comprises a hub and a plurality of blades. The beaching propeller for the military will be made of pristine graphene and have multiple parallel helical ribs arranged in the rear of the propeller hub in a manner that alters the twist rate of exhaust gasses and cooling water expelled from the thru-hub exhaust. These ribs run the length of the inner hub and terminate at the edge of the diffuser ring where the exhaust exits the propeller. The propeller blades have strong blunt edges that can withstand beaching without breaking. In at least some embodiments, the propeller blades are made of aluminum, graphene, or a graphene composite.

A new material has been developed called pristine Graphene which is an allotrope of carbon consisting of a single layer of atoms arranged in a two-dimensional honeycomb lattice nanostructure. Each atom in a graphene sheet makes the material about one hundred times stronger than would be the strongest steel of the same thickness and when integrated with composites minimizes corrosion issues. The lighter weight material is significant to the military as it lowers mission weight of the outboards and is stronger than steel and corrosion resistant as required for propellers.

The new beaching propeller described herein utilizes pristine and other graphenes in the manufacture of the outboard motor propeller. In another embodiment, the propeller is made out of aluminum or stainless steel as well as other graphenes. The graphene material allows for new designs and manufacturing methods to be used and can be simulated for optimum performance. Additionally, the new materials allow the beaching propellers to be made with colors thereby visually identifying which propellers should be selected for a particular mission.

One or more elements of the beaching propeller design include: 1) the beaching propeller minimizes and changes the acoustic signature by increasing hydrodynamic efficiency to minimize the perturbation of water. Helical ribs, internal to the propeller hub, are angled to reduce cavitation, radiated noise, and change the acoustic frequencies during operations; 2) Improves performance, concentrates the thrust in the axial direction and reduces energy wasted in the tangential flow; 3) Constructed of pristine graphene that is ultralight and much stronger than aluminum while providing the ability to withstand impacts that would render traditional propellers inoperable while minimizing detection by mines while also providing better strength for beaching operations.

The helical rib insert will be manufactured using pristine graphene as the primary material and will be installed within the propeller hub and held in place by a bonding agent. A broach, plug or electrolytic cationic machining could be used inside the propeller to form the helical ridges; however, an insert is more manufacturable using the composite graphene material and affixed with a bonding agent.

The beaching propeller features blades made of pristine graphene and composites allowing for minimized weight, increased strength, and minimized detection. The blades are stouter and blunter at the outer edges than a conventional propeller providing additional strength and minimizing damage to the propeller in beach landings (beachings) or impacting objects during brown water missions. The beaching propeller does not impact speed or performance and could help operators avoid threats in mine infested waters where metal propellers could detonate mines.

In at least some embodiments, the beaching propeller is a graphene composite manufacture having rounded/blunt blades for durability and non-corrosion. Further, in some embodiments, interchangeable mounting hubs fitting multiple manufacturers outboard motors are used which reduce underwater signatures via a helical ridge insert. In some embodiments, the beaching propeller is aluminum or stainless steel. In some embodiments, the beaching propeller has one or more colors or other markings for identification of specific missions/uses.

In at least some embodiments, the beaching propeller is an impact resistant composite propeller capable of withstanding impact from beaching and still operate.

In at least some embodiments, the beaching propeller is designed to complete missions in open ocean waters, riverine, and brown water where impacts could destroy the outboard motor. In at least some embodiments, the beaching propeller minimizes the special threats found in minefield situations by reducing underwater metal exposure. In at least some embodiments, the beaching propeller includes more than one blade which are changeable in size as mission/scenario requires. In at least some embodiments, the beaching propeller is made of graphene or other materials, is colorable or markable for ease of identification, and includes blunt edges for strength and beaching.

There has thus been outlined, broadly, features of the beaching propeller in order that the detailed description thereof may be better understood, and in order that the present contribution to the art may be better appreciated. There are additional features of the beaching propeller that will be described hereinafter and that will form the subject matter of the claims appended hereto. In this respect, before explaining at least one embodiment of the beaching propeller in detail, it is to be understood that the beaching propeller is not limited in its application to the details of construction or to the arrangements of the components set forth in the following description or illustrated in the drawings. The beaching propeller is capable of other embodiments and of being practiced and conducted in multiple ways. Also, it is to be understood that the phraseology and terminology employed herein are for the purpose of the description and should not be regarded as limiting.

One object of one or more embodiments is to provide a beaching propeller designed for military operations: specifically for beaching and brown water missions utilizing combat rubber raiding crafts (CRRC's) in areas of high impact to the outboard motor propeller.

Another object of one or more embodiments of the beaching propeller is to provide a high strength, lightweight, beaching propeller that enables boats to withstand beaching and can operate efficiently in brown water operations minimizing damage to the propeller from objects. The military propeller, not being metal, reduces the chance of detonating mines by reducing metal signature. The propeller can be colored or otherwise marked denoting performance desired for the CRRC mission. Propellers can also be made from aluminum or stainless steel if used for commercial applications.

Another object of one or more embodiments is the beaching propeller does not need anti-cavitation holes to enhance the performance of the outboard motor.

Another object of one or more embodiments of the beaching propeller is the capability to be interchangeable with existing propellers with variable sizes and pitches that can operate in riverine and brown water environment.

Another object of one or more embodiments of the propeller is the pristine graphene can be impregnated materials that allows for colors to be embedded marking pitch and size of the propeller for insertion prior to the mission.

Another object of one or more embodiments of the propeller is to provide a beaching propeller that can absorb impact but not damage the lower unit gears or gear housing in the lower unit. The process will be chosen that provides protection to the propeller—yet not so hard a material to allow internal damage to the lower unit gears in the outboard when a heavy impact occurs.

Another object of one or more embodiments of the propeller is the ability to insert hubs of various outboard and inboard motors inside the beaching propeller allowing use on various manufactures motors.

Another object of one or more embodiments of the beaching propeller is the ability to make it in colors for easy recognition when planning missions.

Overview

Turning now descriptively to the drawings, in which similar reference characters denote similar elements throughout the several views, the figures illustrate an example embodiment comprising a new impact propeller for outboard motors that includes a propeller consisting of a hub and multiple number of propeller blades. At the back of the beaching propeller are helical ridges which when integrated complete a body known as a beaching propeller.

FIG. 1 is a front view of a beaching propeller 100, in accordance with some embodiments. This Figure shows an exhaust through hub 102 and three propeller blades 104 evenly distributed around the perimeter of hub 102. In some embodiments, propeller 100 has a larger or smaller number of propeller blades 104. Hub 102 is a hollow cylinder and blades 104 are attached to the exterior of the hub. In some embodiments, blades 104 and hub 102 are formed as a single unit. The hub 102 can be interchanged with other motor manufacturer's hubs allowing the beaching propeller to fit multiple outboard and inboard motors. The interchangeable hub 102 will have a significant cost savings when adapting to other outboard manufacturers' outboard motors, so a unique propeller need not be developed. The drawings are black and white; however, the graphene propellers can be manufactured in colors allowing operators to easily match the propeller to the mission (e.g., Red=fast; Blue=high weight; Black=normal).

Leading Edge of the Propeller Blade

A leading edge 106 of the graphene blade 104 is structured to be reinforced, featuring a variable thickness ranging from 1 to 6 millimeters (mm) thick for optimizing the impact surface for situations involving fast and violent collisions. In at least some embodiments, less than 50% of the blade area is 5 mm in thickness. In at least some embodiments, the blade has a smaller thickness in the area closest to the hub and the thickness increases along the surface extending outward from the hub to the blade edge. In at least one embodiment, the remainder of the blade area which is not 5 mm in thickness is 2 mm in thickness. In at least one embodiment, the blade edge thickness is uniform along the leading and trailing edges. In at least one embodiment, at least one of the leading or trailing edge has the largest thickness. Primary impact points are the focus of strengthening while less commonly impacted surfaces are performance optimized. The leading edge of the propeller is angled to provide the thrust to move the watercraft. The edge 106 itself has a rounded bevel with a radius ranging from 2 to 15 mm with intermittent tangency to the blade 104 surfaces; increasing thrust and debris dispersion. In at least some embodiments, the rounded bevel extends around the entirety of the blade edge. In at least some embodiments, the rounded bevel extends around one of the leading or trailing edge of the blade. With the custom edge geometry, there will be negligible loss to performance at mid to high range. In some embodiments, the smaller blade 104 provides the capability to push more weight and, in other embodiments, the larger blade 104 provides higher top end speed. In another embodiment, the propeller 100 made for the military will be graphene composite material; however, for non-military, aluminum or stainless steel is usable.

In other embodiments, blade 104 has a different overall shape.

Figure 2:
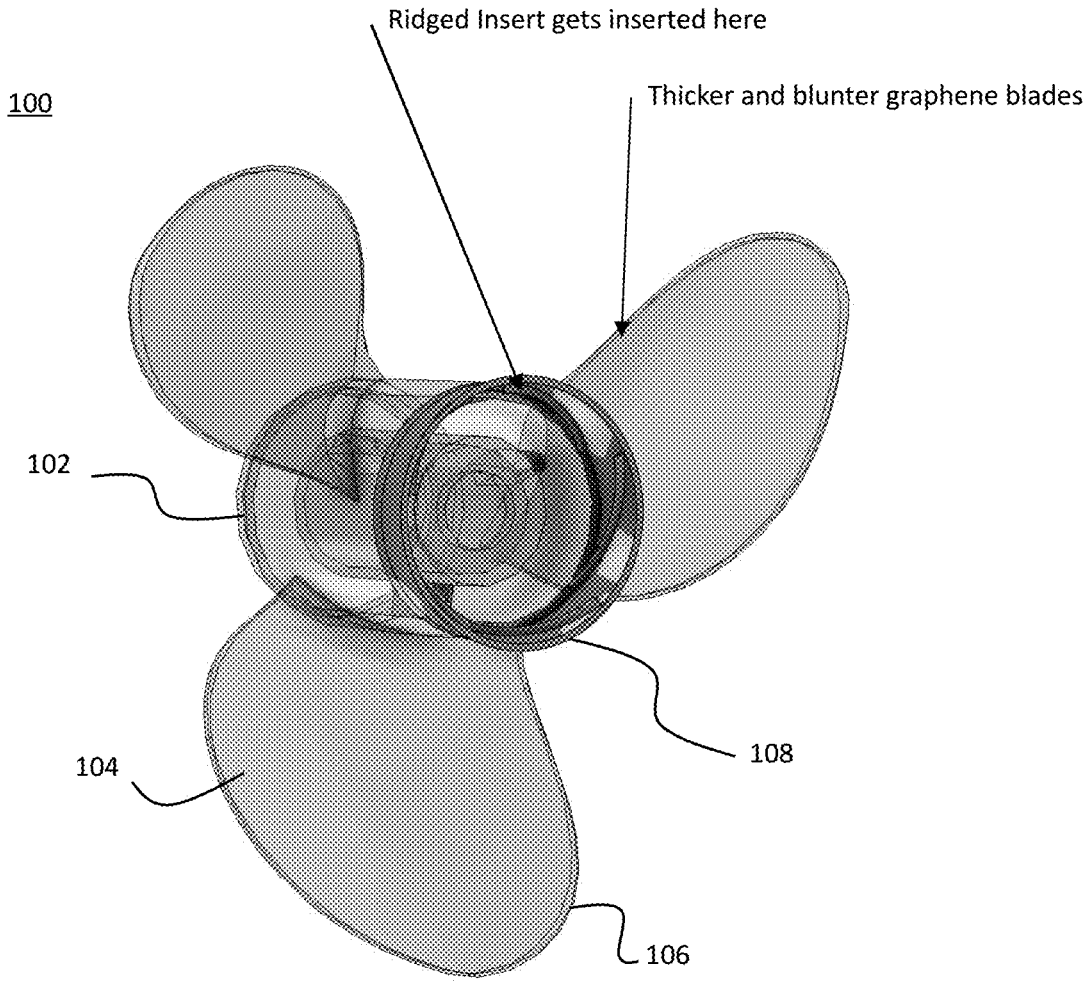
FIG. 2 is a rear perspective view of the beaching propeller, in accordance with some embodiments.

FIG. 2 is a rear perspective view of the beaching propeller 100, in accordance with some embodiments. This view shows the blades 104 are thicker to absorb impact better than the commercial propeller blades. In at least some embodiments, the blade thickness ranges from 1 to 6 mm. In at least some other embodiments, the blade thickness ranges from 5 to 6 mm. Thicker blades relate to stronger blades which are able to absorb more impact. The stronger blades 104 are made of a graphene composite. For non-military application embodiments, aluminum or stainless steel are usable for the blades 104. The helical ridge insert is in place. A helical ridge insert 108 is placed in the back of hub 102 and secured. In at least one embodiment, the insert 108 is secured in the hub 102 using an adhesive. In at least some embodiments, the insert 108 is welded in the hub 102. In other embodiments, different mechanisms could be used to secure the insert.

The leading edge 106 of the graphene blade 104 is structured to be a blunt surface with thicker material than a traditional propeller for impact purpures. For maximum performance, no more than 50 percent of the leading edge 106 is blunted to provide strength and not lose performance. The leading edge 106 of the propeller 100 is angled to provide the thrust to move the watercraft having the propeller attached. With the custom edge geometry, there will be negligible loss to performance at mid to high range. In some embodiments, the smaller blade 104 provides the capability to push more weight and, in other embodiments, the larger blade 104 provides higher top end speed. In some embodiments, the propeller 100 made for the military will be graphene composite material; however, for non-military aluminum or stainless steel are usable.

Figure 3:
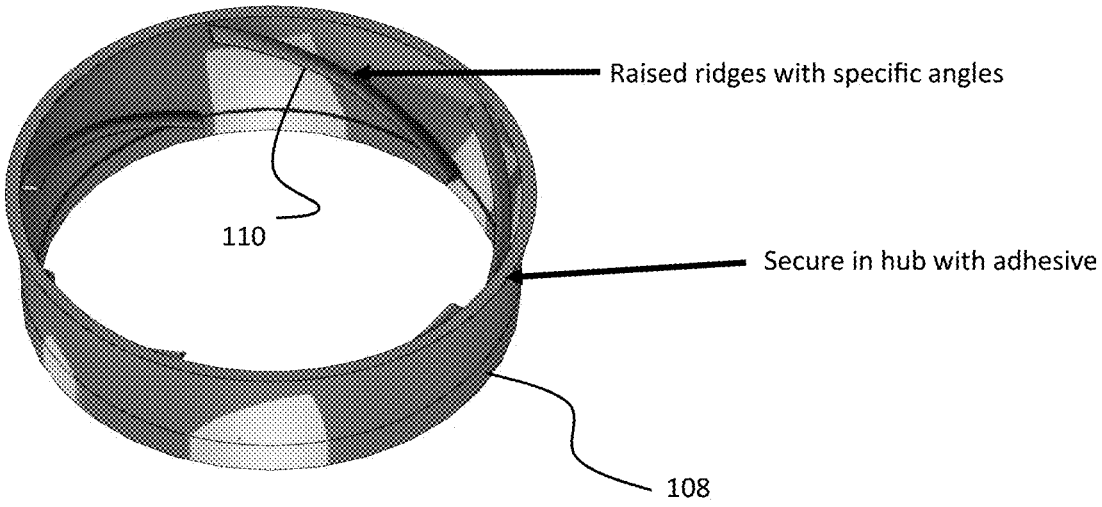
FIG. 3 is a rear perspective view of a helical insert usable in conjunction with the beaching propeller, in accordance with some embodiments.

FIG. 3 is a rear perspective view of a helical insert 108 usable in conjunction with the beaching propeller 100, in accordance with some embodiments. Helical insert 108 is a hollow cylinder. Insert 108 includes five ridges 110 raised on an interior surface (i.e., inner face) of the insert 108. In at least some embodiments, insert 108 includes larger or smaller number of raised ridges 110 on the inner face.

Figure 8:
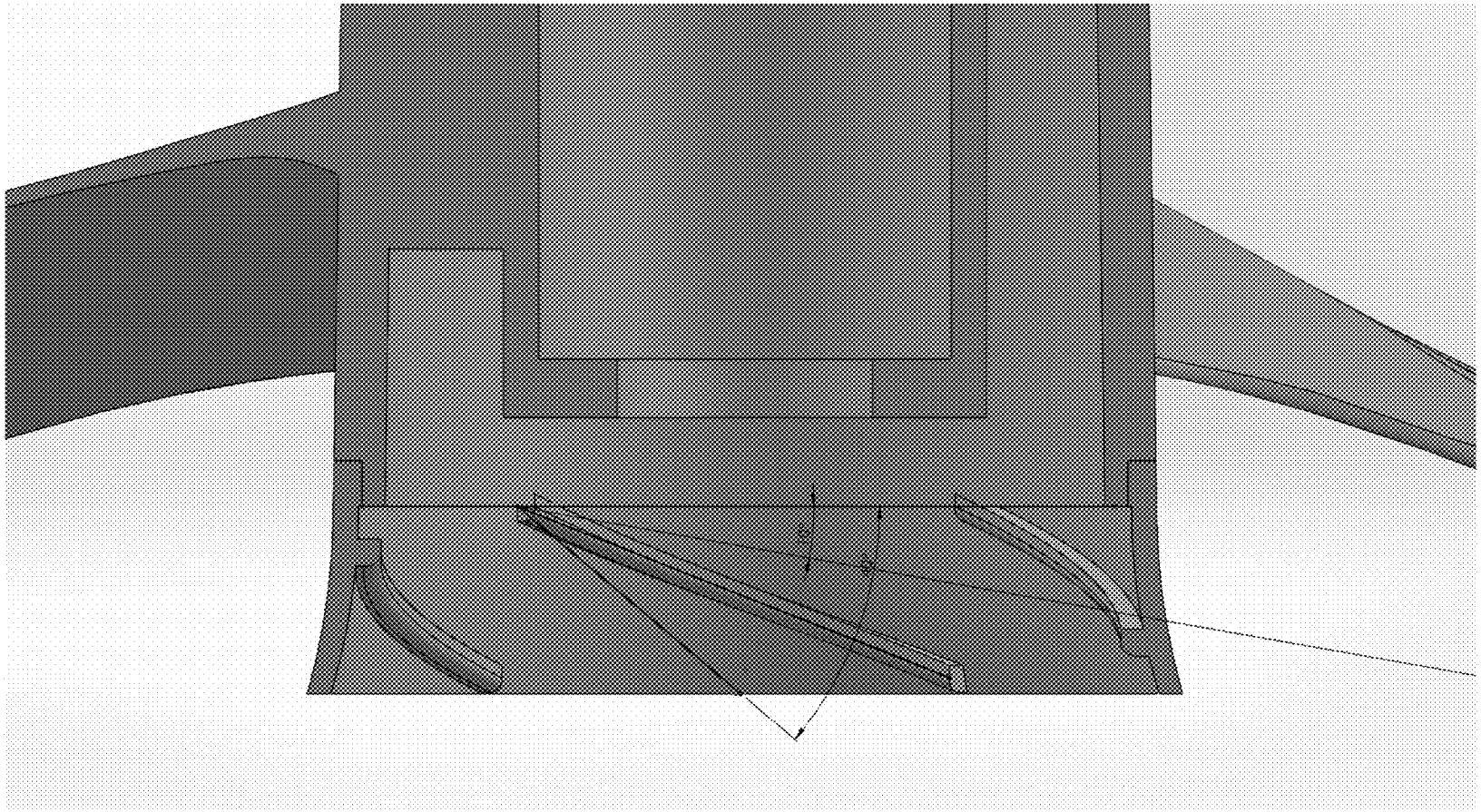
FIG. 8 is a cross-section view of a helical insert usable in conjunction with the beaching propeller, in accordance with some embodiments.

Each of the raised ridges 110 extend at an angle to an edge of an opening of the insert 108. The raised ridges 110 extend around an inner perimeter of the insert 108. The raised ridges 110 are arranged in a non-overlapping manner around the inner face. In at least some embodiments, the raised ridges 110 are arranged in an overlapping manner around the inner face. In at least some embodiments, the raised ridges 110 are arranged in a sequential, non-overlapping manner around the inner face of the insert 108. In a non-overlapping embodiment, the gap between sequential raised ridges ranges from 0-2.5 mm. FIG. 8 is a cross-section view of the insert showing the raised ridges 110. As depicted, an angle of the raised ridge 110 with respect to perpendicular to the longitudinal axis of the hub 102 ranges from 10° to 40°.

In at least some embodiments, the raised ridges 110 form an acute angle at a location of intersection with a circumferential line around the insert 108. A height of each of the raised ridges 110 from the inner surface ranges from 2.5 to 13 mm. The height of the raised ridges 110 is varied in embodiments depending on engine and performance needs.

The ridges located in the propeller at the back improve performance and reduce acoustic signatures in military scenarios. Examples are when conducting littoral coastal missions primarily hydrographic reconnaissance or in surf passages, the multiple parallel helical ribs are arranged in a manner that alter the twist rate of exhaust gasses and cooling water expelled from the thru-hub exhaust.

Figure 4:
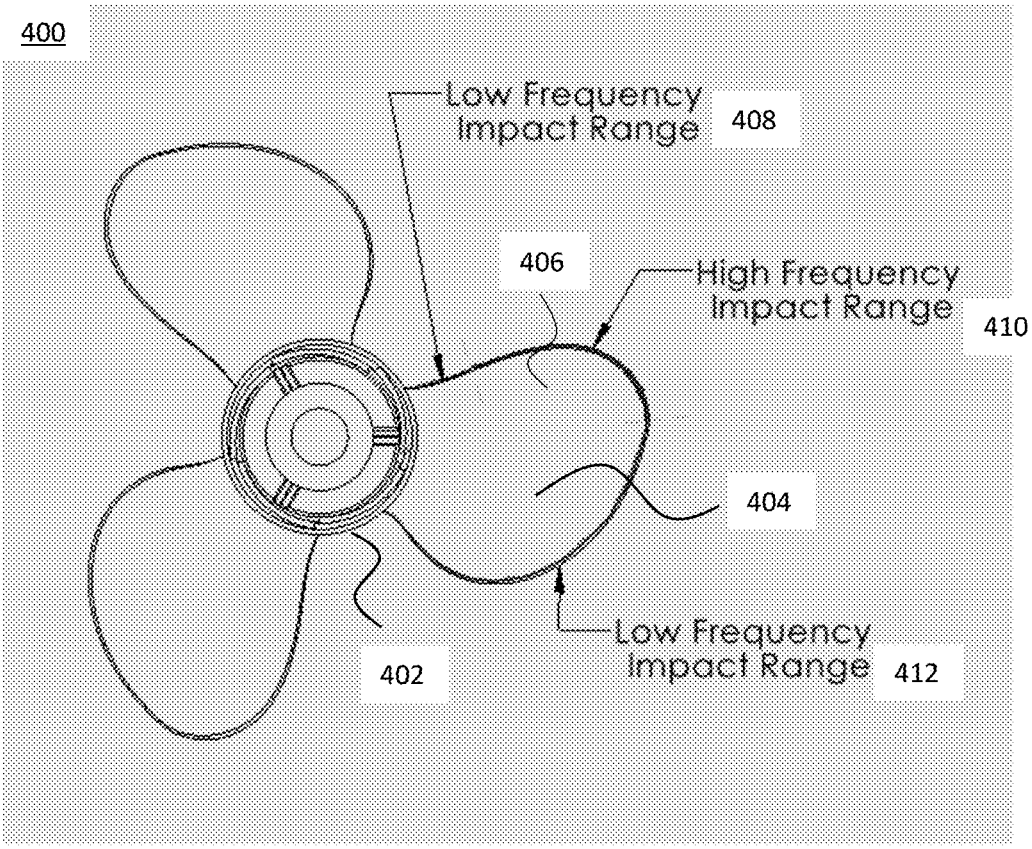
FIG. 4 is a front plan view of a beaching propeller, in accordance with some embodiments.

FIG. 4 is a front plan view of a beaching propeller 400 having a similar configuration to propeller 100, in accordance with some embodiments. Propeller 400 includes a hub 402 (similar to hub 102), three blades 404 (similar to blades 104), and the blades 404 have leading edges 406 (similar to edges 106). As depicted different portions of the blades 404 cause a different portion of the frequency of the propeller 400 moving through the water. A low frequency impact range 408 extends from the attachment point of the blade 404 to hub 402 along a portion of the leading edge 406. A high frequency impact range 410 extends along the leading edge 406. A low frequency impact range 412 extends from the end of the leading edge and high frequency impact range 410 along the trailing edge of the blade 404.

Figure 5:
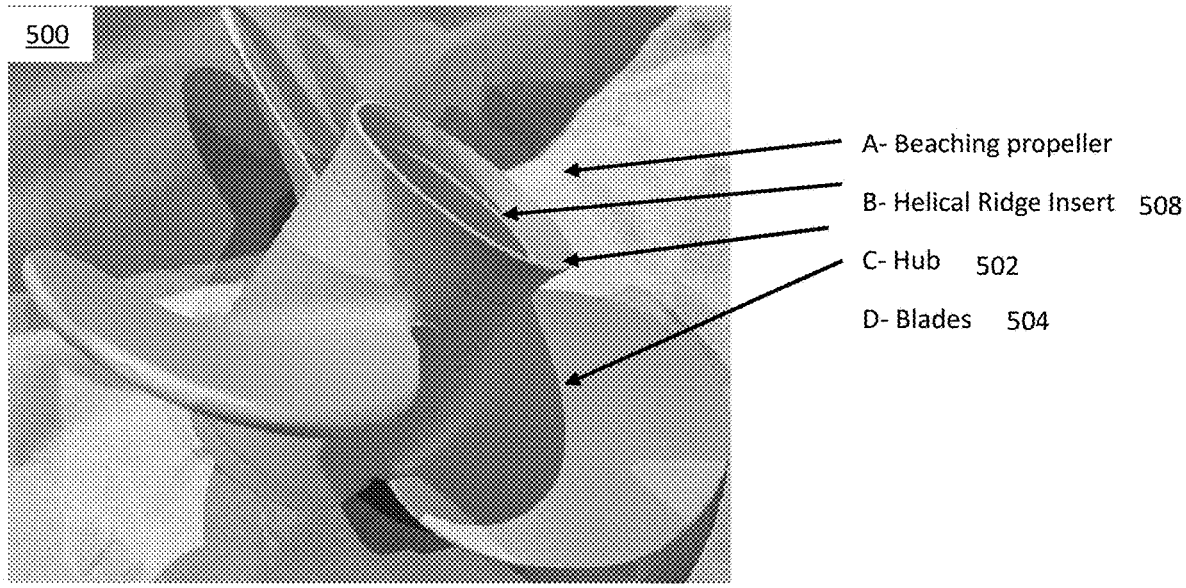
FIG. 5 is a side perspective view of a beaching propeller, in accordance with some embodiments.

FIG. 5 is a side perspective view of a beaching propeller 500, in accordance with some embodiments. Beaching propeller 500 is similar to beaching propeller 100 and 400. Beaching propeller 500 includes a hub 502 (similar to hub 102), three blades 404 (similar to blades 104), and a helical ridge insert 508 (similar to insert 108). Helical ridge insert 508 is generally cylindrically shaped with one end having a flared open wider than the other end. In at least some embodiments, the flared opening is 2.5 mm wider in diameter than the other end. In at least some embodiments, the flared opening assists with tracking of the boat during operation.

Hub Exhaust Channel

The ridges (e.g., raised ridges 110 of FIG. 1) located in the propeller hub 100, in the rear, improve performance and distort acoustic signatures in military scenarios. The pitch of the helix ridges is molded to a range of from 95 to 100 mm. In at least one embodiment, the pitch is 98 mm. There are five separate ridges 110, however, this number of ridges are subject to change based upon acoustic and performance testing. Graphene propellers of a given geometry have predictable acoustic signatures, allowing monitoring agents to identify the propeller and subsequently the vehicle that it propels. The introduction of these ridges 110 changes the acoustic signature of the beaching propeller, making the vehicle harder to identify. Performance of the engine is also improved when conducting littoral coastal missions primarily hydrographic reconnaissance or in surf passages, the multiple parallel helical ribs (ridges) increase the velocity and expulsion rate of exhaust gasses subsequently lowering exhaust back-pressure which increases engine performance. Water expelled from the thru-hub exhaust is rapidly cooled, reducing heat signatures.

Trailing Edge of the Propeller Blade

The trailing edge of the propeller blade is manufactured to fit a range of profiles like a typical propeller blade depending on pitch and size blade 104 desired. The entire width and number of blades 104 can change to meet multiple designs to fit the desired profile of the complete propeller required by the military. The blade 104 design can change depending upon the mission profile.

The structural variations of the trailing edge of the propeller 100 are associated with the width and dimensions of the propeller. This can lead to multiple functional variations depending upon demands on performance, weight, or surf. The beaching propeller blade 104 designed for the Raider Outboard motor; however, will fit other makes and models. The lower unit protective shroud could be built to fit commercial outboard motors.

Connections of Main Elements and Sub-Elements of One or More Embodiments

The main elements of the beaching propeller 100 center around the graphene propeller. The beaching propeller 100 will be manufactured without the center hub 102; when the propeller is ordered the correct center hub will be inserted for that outboard motor. The beaching propeller 100 is manufactured allowing multiple manufacturers' hubs to be inserted in the propeller. Thus, the beaching propellers 100 can be fit to other outboards in addition to the military. The blades 104 will be designed for missions of speed or weight with operations that include beaching, brown water, or mines.

Figure 6:
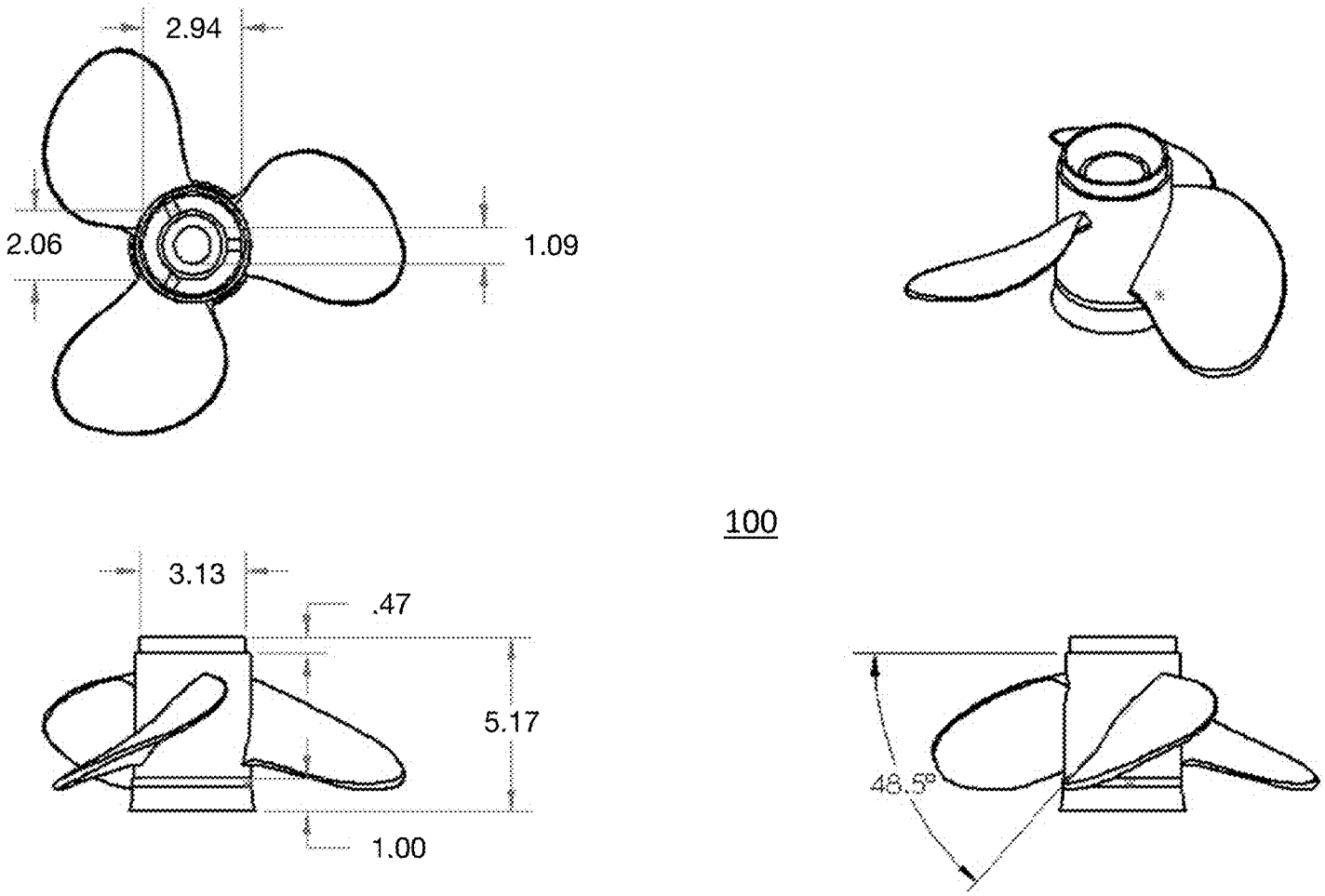
FIG. 6 is several views of a beaching propeller, in accordance with some embodiments.

FIG. 6 includes several views of a beaching propeller 100, in accordance with some embodiments. As depicted, the blades 104 form an angle of approximately 48.5° with respect to the longitudinal length of the hub 102. In at least some embodiments, the blades 104 form larger or smaller angles with respect to the hub 102.

As depicted, hub 102 is approximately 130 mm in length and 80 mm in diameter. In at least some embodiments, hub 102 is larger or smaller in length and/or diameter.

Figure 7:
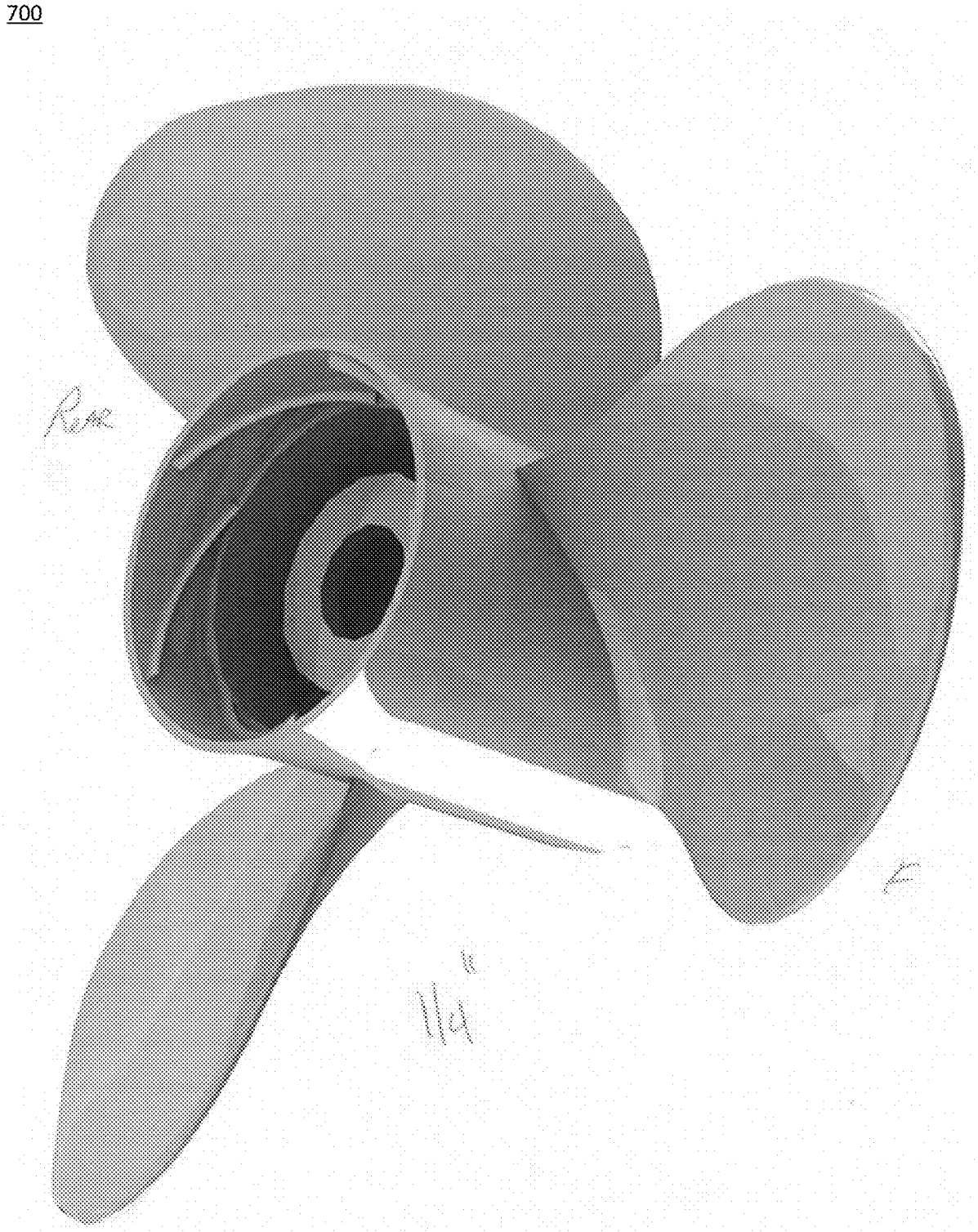
FIG. 7 is a perspective view of a beaching propeller, in accordance with some embodiments.

FIG. 7 is a side perspective view of a beaching propeller 700, in accordance with some embodiments.

The beaching propeller will be made for the military operations. If long range missions are required with minimum weight-a higher pitch beaching propeller will be used having extended length/blade shape. The ability to color or otherwise mark the beaching propellers will immediately tell the mission planner which color to use for the mission. The advantage of graphene composite beaching propeller is higher rigidity than aluminum, minimized exposure to metal, minimized sound frequency under water and superior fatigue qualities. Propellers have been around for hundreds of years with basic sizes and dimensions available from various manufacturers. There are no graphene blades currently available for commercial or civilian use.

Operation of an Embodiment

The beaching propeller will be installed on the military outboard motors designed for the military missions. This outboard motor propeller will be used in environments where beaching operations are in the mission profile or in brown water scenarios where impact of an ordinary propeller would be damaged. The robust propeller blades are designed to be manufactured with graphene as the base material for ruggedness, which is a lightweight material that is stronger than aluminum but not as hard as stainless steel. It was selected for impact resistance; however, composite strength can be controller so the blade will break before the internal gears in the outboard motor lower unit will get damaged.

Unless otherwise defined, all technical and scientific terms used herein have the same meaning as commonly understood by one of ordinary skill in the art to which this invention belongs. Although methods and materials like or equivalent to those described herein can be used in the practice or testing of the beaching propeller, suitable methods and materials are described above. All publications, patent applications, patents, and other references mentioned herein are incorporated by reference in their entirety to the extent allowed by applicable law and regulations. The beaching propeller may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

In at least one aspect, a propeller comprises a propeller hub, two or more blades connected with the propeller hub, and an insert having a tubular shape with an inner and outer face, the insert having a raised ridge on the inner face, the insert being connected to at least a portion of the propeller hub.

In at least one aspect, an insert for a propeller has a tubular shape and comprises a raised ridge on an inner face of the insert.

In at least one aspect, a propeller comprises a propeller hub; three blades connected with the propeller hub; and an insert in at least a portion of the propeller hub. The insert has a tubular shape has inner and outer faces, five helical raised ridges on the inner face, and each of the blades comprises pristine graphene.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A propeller comprising:

a propeller hub;

two or more blades connected with the propeller hub; and an insert having a tubular shape with an inner and outer face, the insert having a raised ridge on the inner face, the insert being inserted in at least a portion of the propeller hub, the insert being secured in the propeller hub using an adhesive.

2. The propeller of claim 1, wherein the raised ridge is more than one raised ridge.

3. The propeller of claim 2, wherein the raised ridge is five raised ridges.

4. The propeller of claim 1, wherein the raised ridge extends at an angle to an edge of an opening of the insert.

5. The propeller of claim 1, wherein sequential raised ridges are arranged in a non-overlapping manner around the inner face.

6. The propeller of claim 1, wherein each blade of the two or more blades comprises graphene or a graphene composite.

7. The propeller of claim 1, wherein each blade of the two or more blades comprises pristine graphene.

8. The propeller of claim 1, wherein the propeller has a color corresponding to one or more parameters of the propeller.

9. The propeller of claim 8, wherein the one or more parameters includes pitch of the two or more blades, thickness of a leading edge of the two or more blades, thickness of a trailing edge of the two or more blades.

10. The propeller of claim 1, wherein the raised ridge extends helically on the inner face.

11. An insert for a propeller, the insert having a tubular shape and comprising:

a raised ridge on an inner face of the insert, and wherein the raised ridge is five raised ridges.

12. The insert of claim 11, wherein the raised ridge helically extends on the inner face.

13. The insert of claim 11, wherein the raised ridge is more than one raised ridge.

14. The insert of claim 11, wherein the raised ridge extends at an angle to an edge of an opening of the insert.

15. The insert of claim 11, wherein sequential raised ridges are arranged in a sequential, non-overlapping manner around the inner face.

16. The insert of claim 11, wherein the insert comprises graphene or a graphene composite.

17. The insert of claim 11, wherein the insert comprises pristine graphene.

18. A propeller comprising:

a propeller hub;

three blades connected with the propeller hub; and an insert in at least a portion of the propeller hub, wherein the insert has a tubular shape having inner and outer faces, the insert having five helical raised ridges on the inner face.

19. The propeller of claim 18, wherein the insert is secured in the propeller hub using an adhesive.

* * * * *